US006046757A

United States Patent [19]

Kanai

[11] Patent Number: 6,046,757

[45] Date of Patent: Apr. 4, 2000

[54] THERMAL PRINTER HAVING THERMAL HEAD UNIT SUPPORT STRUCTURE

[75] Inventor: Masashi Kanai, Chiba, Japan

[73] Assignee: Seiko Instruments Inc., Japan

[21] Appl. No.: 08/574,123

[22] Filed: Dec. 18, 1995

[51] Int. Cl.[7] ..... B41J 25/316; B41J 25/304

[52] U.S. Cl. ..... 347/197

[58] Field of Search ..... 347/197; 400/120.16

[56] References Cited

U.S. PATENT DOCUMENTS 5,366,302 11/1994 Masumura et al. ..... 400/120.16

FOREIGN PATENT DOCUMENTS 298643 1/1989 European Pat. Off. .
4219798 12/1993 European Pat. Off. .

OTHER PUBLICATIONS

Patent Abstracts of Japan, vol. 12, No. 340, (M–740) Sep. 13, 1988.
Patent Abstract of Japan, vol. 12, No. 374, (M–749) Oct. 6, 1988.
Patent Abstract of Japan, vol. 13, No. 177, (M–818) Apr. 26, 1989.

*Primary Examiner*—Huan Tran
*Attorney, Agent, or Firm*—Adams & Wilks

[57] ABSTRACT

A thermal printer comprises a frame having a pair of side frame members opposed to each other at a given distance according to a desired width size standard of a recording medium. A platen roller unit is rotatably disposed between the side frame members of the frame. A thermal head unit is disposed between the side frame members of the frame and faces the platen roller unit. A pressure member unit is rotatably supported by the frame and is positionable at a predetermined position for biasing the thermal head unit into pressing contact with the platen roller unit. A head unit pressure lever is rotatably supported by the frame for retaining the pressure member unit at the predetermined position.

19 Claims, 5 Drawing Sheets

THERMAL PRINTER HAVING THERMAL HEAD UNIT SUPPORT STRUCTURE

BACKGROUND OF THE INVENTION

1. Field of the Invention

The present invention relates to a thermal printer provided with a platen roller unit and a thermal head unit, and more specifically to a support structure for a thermal head unit.

2. Background Information

One example of a conventional thermal printer provided with a platen roller and a thermal head is shown in FIGS. 4A, 4B and 5. The thermal printer has a platen roller 20 rotatably mounted on a frame 22 in the width direction of a sheet of recording medium (not shown). A thermal head 24 is fixedly supported by a head unit 26 and is in facing relationship with the platen roller 20 and arranged so as to come into pressing contact with the platen roller 20. The thermal head 24 is provided with a pressure member which is integrally attached to the rear surface of the thermal head 24 through screws or the like and which causes the thermal head 24 to come into pressing contact with the platen roller 20.

The pressure member comprises a resilient member 28 and a head unit pressure plate 30 which are arranged such that the resilient member 28 is interposed between the head unit pressure plate 30 and the head unit 26 so that the pressure member expands and contracts elastically within a predetermined clearance between the two. As a result, when the thermal head 24 is assembled in a predetermined position in the frame 22 of the thermal printer together with the pressure member, the thermal head 24 contacts the platen roller 20 with a predetermined pressure contacting force (FIG. 4B).

In the conventional thermal printer shown in FIGS. 4A, 4B and 5, the thermal head 24 is integrally supported by the head unit pressure plate 30 of the pressure member through the head unit 26, and when the thermal head 24 is brought into pressure contact with the platen roller 20 by the action of the resilient member 28 of the pressure member, the resilient member 28 applies a uniform energizing force to the thermal head 24 so as to absorb a one-sided or biased contact.

However, in the conventional thermal printer shown in FIGS. 4A, 4B and 5, the pressure member and the thermal head 24 are integrated and the pressure member is fixedly supported at one end thereof to the frame 22 by fixing means such as screws 32. Thus maintenance and replacement of the thermal head 24 becomes more complicated and time consuming since the pressure member and the thermal head 24 are not independent of each other and removal of the fixing means 32 becomes necessary. Furthermore, tools are often required to provide a large opening at the pressure contact portion between the platen roller 20 and the thermal head 24 during replacement of the thermal head 24 or removal of a paper jam, thereby causing drawbacks that maintenance of the thermal printer and replacement of components are laborious and time-consuming.

SUMMARY OF THE INVENTION

In view of the above noted drawbacks of the prior art, an object of the present invention is to provide an improved thermal printer having a structure effective to facilitate assembling and disassembling of the thermal printer.

Another object of the present invention is to provide an improved thermal printer having a support structure which allows a thermal head unit to be easily removed from a frame of the thermal printer and which has a large opening between the thermal head unit and a platen roller unit to facilitate maintenance and replacement of the thermal head unit.

In order to achieve the above objects and others, the present invention comprises a frame, a platen roller unit, a thermal head unit, a pressure member unit and a head unit pressure lever. The frame has a pair of side frame members opposed to each other at a given distance according to a desired width size standard of recording medium. The platen roller unit is disposed between the pair of side frame members such that the platen roller unit is detachably and rotatably supported by the side frame members. The thermal head unit is disposed between the pair of side frame members to face the platen roller unit. The pressure member unit is assembled into the frame of the thermal printer for bringing the thermal head unit into pressing contact with the platen roller unit.

The thermal head unit comprises a heat radiating plate supporting a heat generating element for contacting the platen roller unit. The thermal head unit is detachably supported with respect to the pair of side frame members. The pressure member unit can be brought into point contact with the thermal head unit by the head unit pressure lever so that during printing, the pressure member unit biases the heat generating element of the thermal head unit into pressing contact with the platen roller unit and the thermal head unit can tilt and float forward/rearward and rightward/leftward relative to the platen roller unit.

The pressure member unit comprises first and second head unit pressure plates rotatably supported with respect to the frame of the thermal printer, and a biasing member disposed between the first and second head unit pressure plates such that the first and second head unit pressure plates can elastically expand and contract within a predetermined clearance therebetween due to the biasing force of the biasing member. The head unit pressure lever has a head unit pressure shaft and is rotatably supported between the pair of side frame members. The head unit pressure shaft of the head unit pressure lever retains the first head unit pressure plate of the pressure member unit from behind the thermal head unit such that the heat generating element of the thermal head unit is biased into pressing contact with the platen roller unit.

According to the present invention, the thermal head unit and the pressure member unit are independent from one another and can be separably assembled. One of the thermal head unit or the second head unit pressure plate of the pressure member unit is provided with a convex spherical contact portion, while the other of the thermal head unit and the second head unit pressure plate of the pressure member unit is provided with a flat contact surface portion. The convex spherical contact portion and the flat contact surface portion come into point contact with each other when the pressure member unit biases the thermal head unit into pressing contact with the platen roller unit.

When the head unit pressure lever is rotated relative to the frame toward the platen roller unit, the head unit pressure shaft of the head unit pressure lever is separated from and releases the first head unit pressure plate of the pressure member unit, thereby releasing the pressure member unit from contact with the thermal head unit. The thermal head unit can then be released from contact with the platen roller unit to provide a large opening or space between the thermal head unit and the platen roller unit to permit maintenance or replacement of the thermal head unit.

According to the present invention, the thermal head unit and the pressure member unit are independent of each other, and assembly and removal of the thermal head unit into and from the thermal printer during a replacement operation can be easily performed by manual operation of the head unit pressure lever without requiring any tools. Furthermore, since the pressure member unit can be brought into point contact with the thermal head unit and the thermal head unit can tilt or float forward/rearward and rightward/leftward relative to the platen roller unit, the thermal head unit can be brought into pressing contact with the platen roller unit uniformly so that biased or one-sided contact between the thermal head unit and the platen roller unit can be prevented and the printing quality and the rectilinearity of the recording medium can be effectively improved.

DETAILED DESCRIPTION OF THE PREFERRED EMBODIMENT

A preferred embodiment of the present invention will be described with reference to the accompanying FIGS. 1–3.

Figure 1:
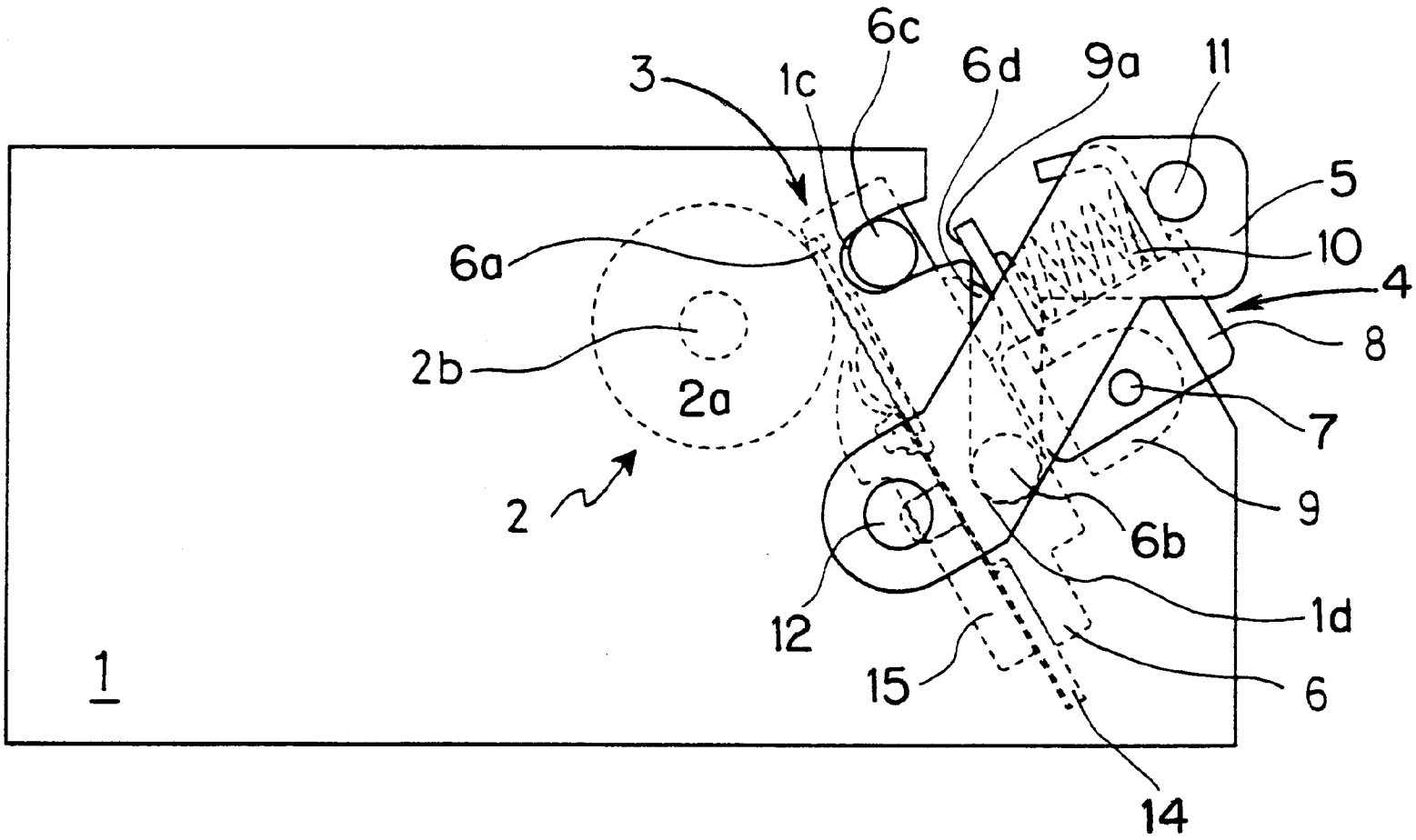
FIG. 1 is a schematic sectional side view of the basic structure of a thermal printer according to the present invention.
Figure 2:
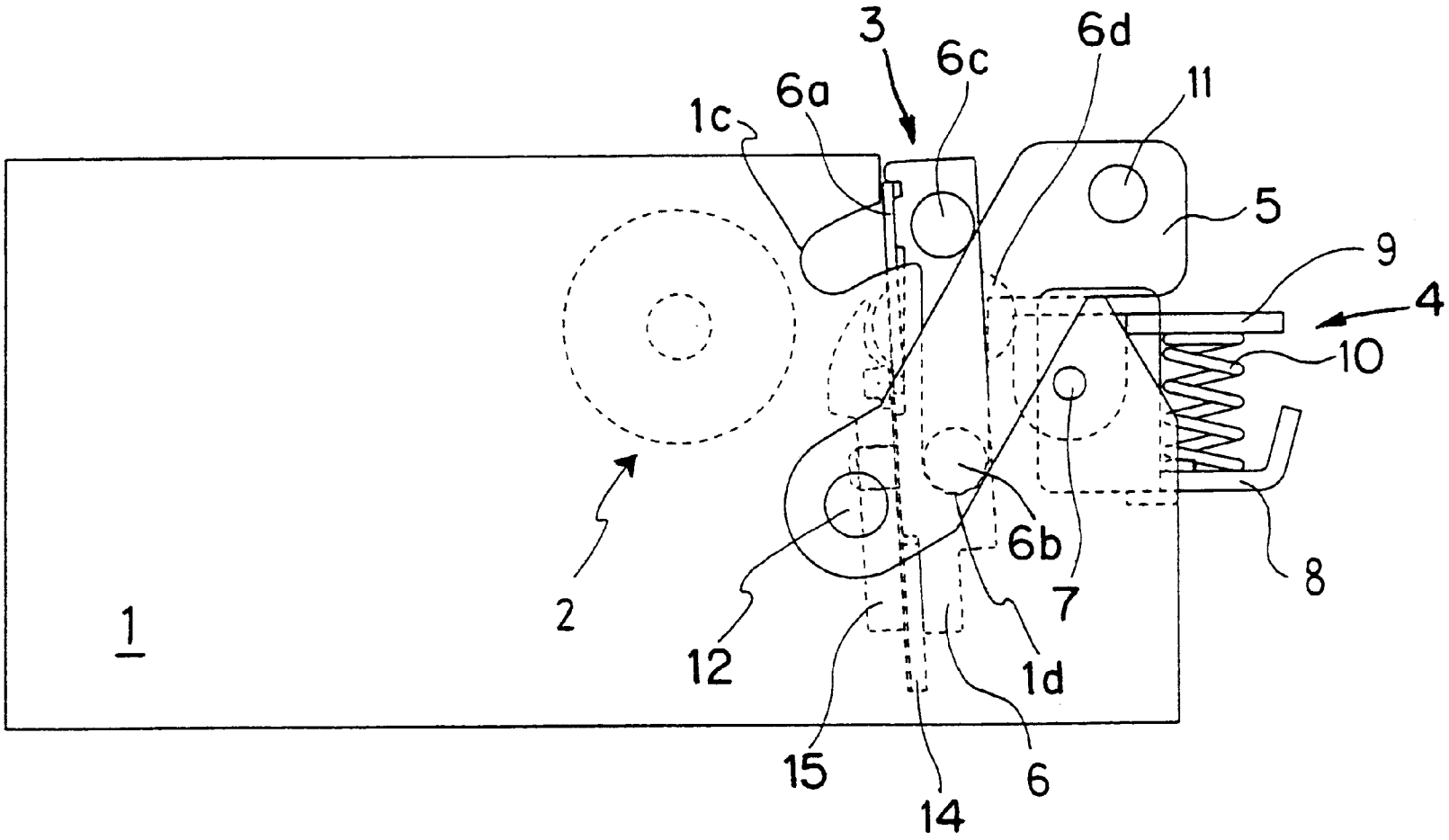
FIG. 2 a sectional side view of the thermal printer shown in FIG. 1 showing the thermal head unit in a released noncontact position relative to the platen roller unit.

Referring to FIGS. 1–2, the thermal printer according to the present invention comprises a frame 1, a platen roller unit 2, a thermal head unit 3, a pressure member unit 4 for biasing the thermal head unit 3 into pressing contact with the platen roller unit 2, and a head unit pressure lever 5 for retaining the pressure member unit 4 at a predetermined position on the frame 1 to bring the thermal head unit 3 into pressing contact with the platen roller unit 2.

Figure 3:
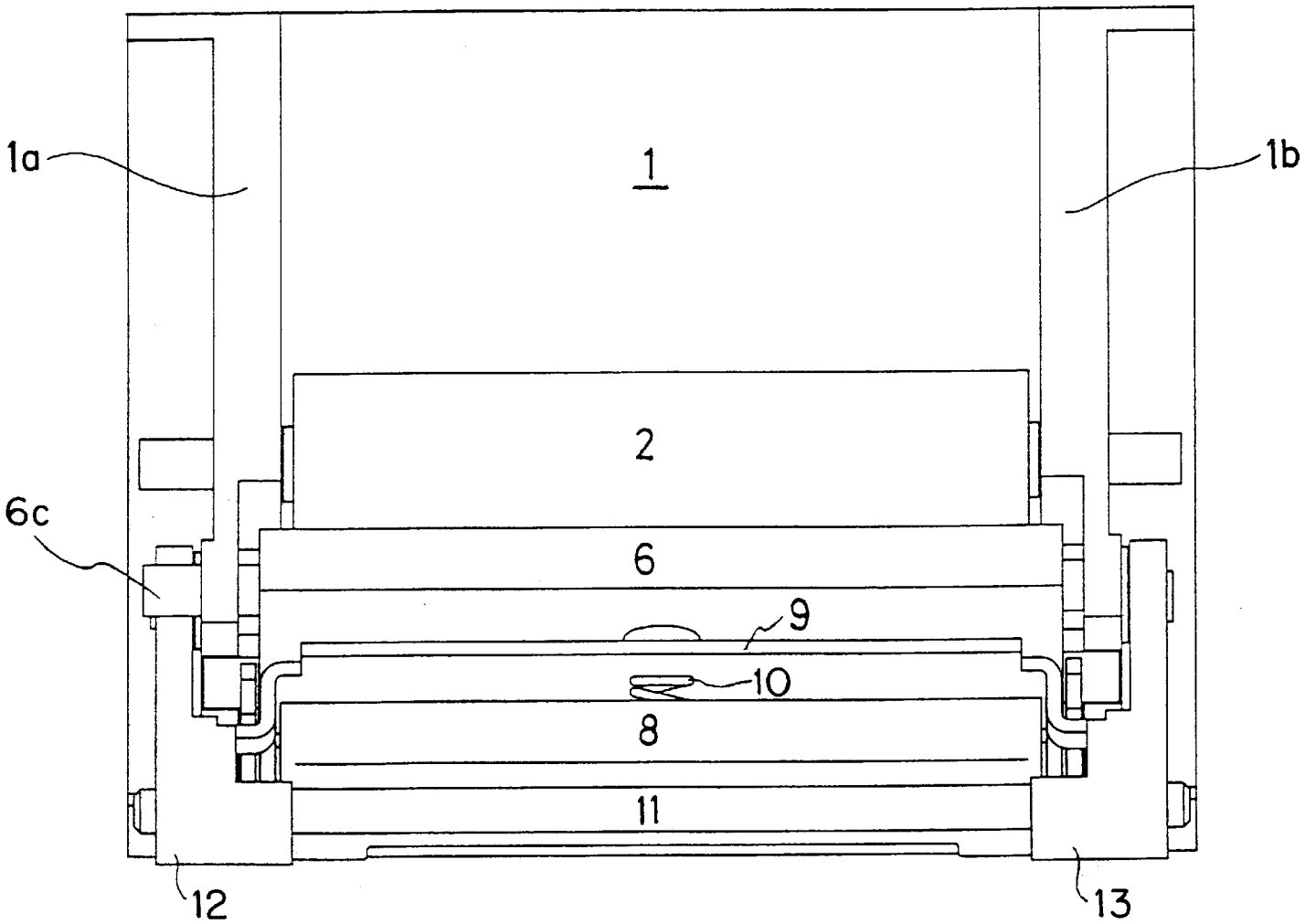
FIG. 3 is a schematic front view of the thermal printer according to the present invention.
Figure 4A:
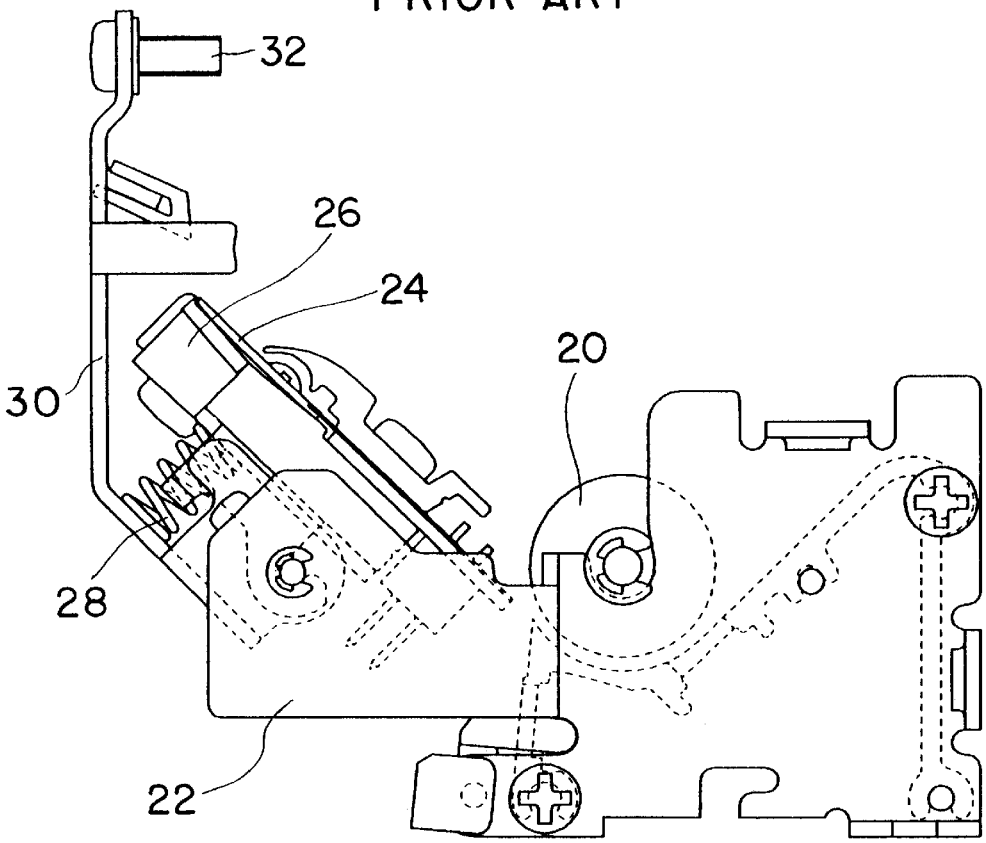
FIG. 4A PRIOR ART
FIGS. 4A and 4B are schematic sectional side views of a conventional printer.
Figure 4B:
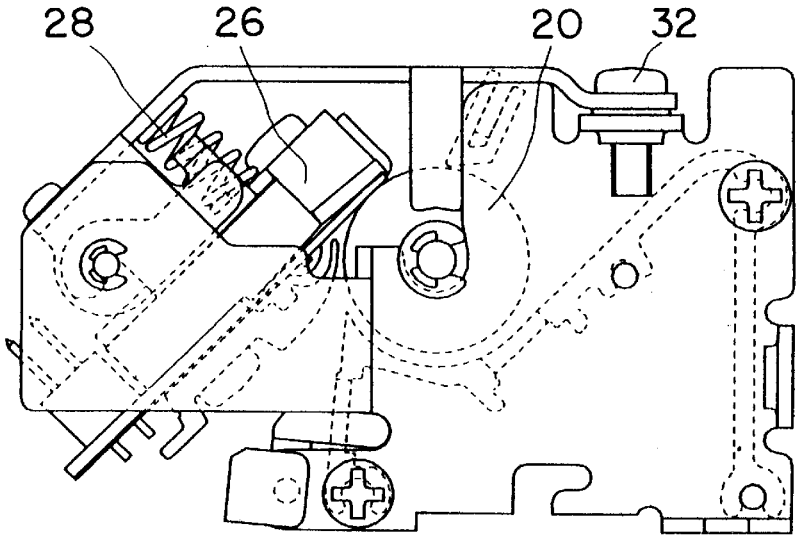
FIG. 4B PRIOR ART
Figure 5:
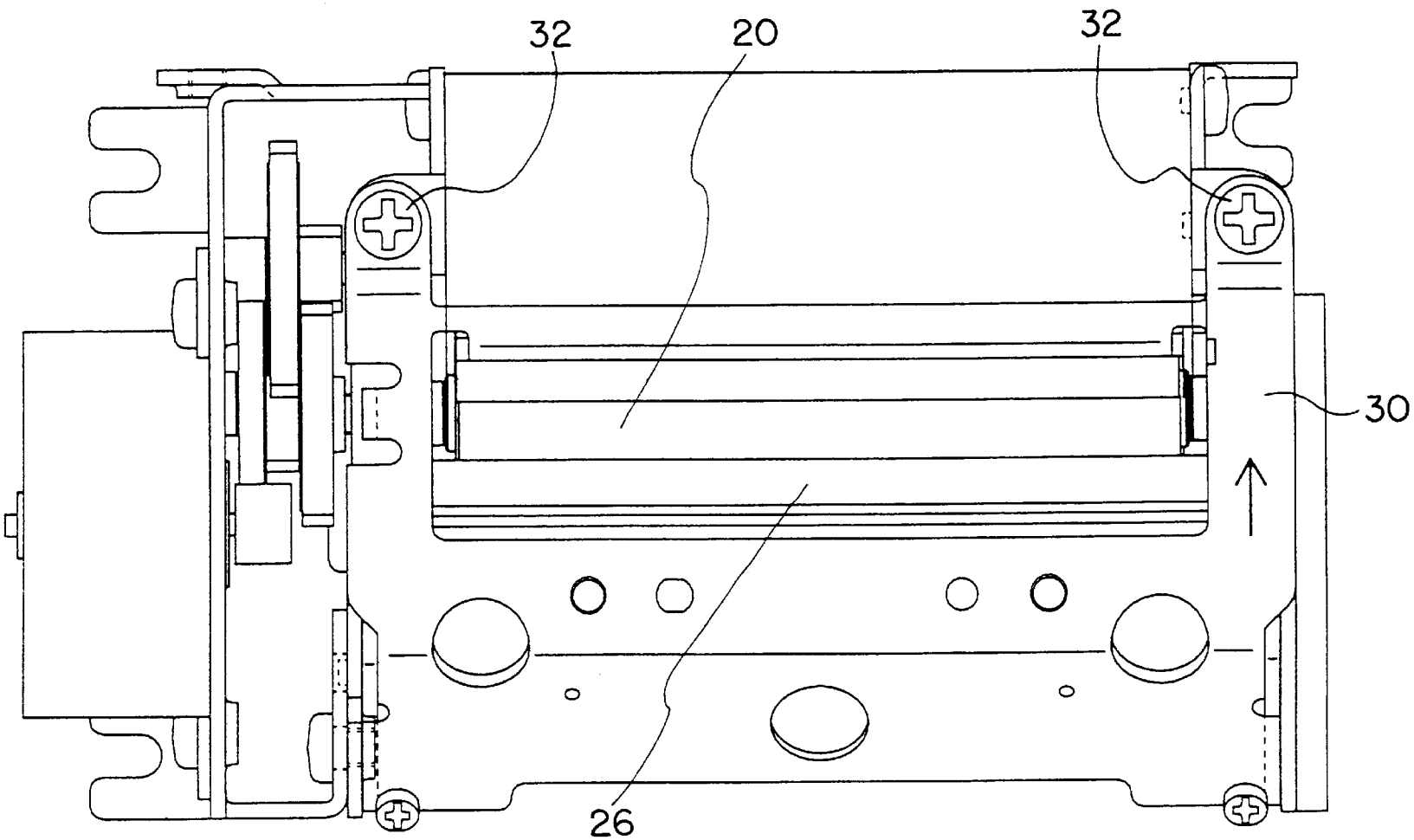
FIG. 5 PRIOR ART
FIG. 5 a schematic front view of the conventional printer.

As shown in FIG. 3, the frame 1 has a pair of side frame members 1*a*,1*b* opposed to each other in spaced relation in the width direction of a sheet of a recording paper (not shown) at a given interval or distance in registration with one of the width size standards of recording paper or printing medium. The platen roller unit 2 is disposed between the pair of side frame members 1*a*,1*b* and is detachably rotatably supported with respect to the pair of side frame members 1*a*,1*b*.

Referring again to FIGS. 1–2, the platen roller unit 2 comprises a tubular resilient platen roller 2*a* made of rubber or the like and a roller shaft 2*b* passing through the center of the platen roller 2*a*, with opposite end portions of the roller shaft 2*b* being detachably and rotatably supported by the pair of side frame members 1*a*,1*b*.

The thermal head unit 3 is disposed to face the platen roller unit 2 and is detachably supported with respect to the pair of side frame members 1*a*,1*b*. The thermal head unit 3 comprises a heat radiating plate 6 having a heat generating element 6*a* vmounted on a surface thereof facing the platen roller unit 2, and a pair of pins 6*b*,6*c* located on opposite sides of the heat radiating plate 6. The pins 6*b*,6*c* are adapted to be respectively inserted into grooves 1*c*,1*d* formed on the pair of side frame members 1*a*,1*b*, respectively. The heat radiating plate 6 and the pins 6*b*,6*c* may be formed integrally of, for example, aluminum or other suitable material.

The pressure member unit 4 is rotatably assembled into the frame 1 through a support shaft 7 passing through the frame 1 and it is positioned so as to bring the thermal head unit 3 into pressing contact with the platen roller unit 2 by means of the head unit pressure lever 5. The pressure member unit 4 comprises first and second head unit pressure plates 8,9 rotatably supported with respect to the frame 1, and a biasing member, such a spring 10, disposed between the first and second head unit pressure plates 8,9 such that the first and second head unit pressure plates 8,9 can elastically expand and contract within a predetermined clearance therebetween due to the elastic force of the spring 10.

As best shown in FIG. 1, according to the present embodiment, the second head unit pressure plate 9 is provided with a flat surface contact portion 9*a*, and the heat radiating plate 6 of the thermal head unit 3 is provided with a convex spherical contact portion 6*d*. The spring 10 generates a resilient pressure force which biases the flat surface contact portion 9*a* of the second head unit pressure plate 9 into point contact with the convex spherical contact portion 6*d* of the heat radiating plate 6 which, in turn, biases the heat generating element 6*a* of the thermal head unit 3 into pressing contact with the platen roller unit 2. The point contact between the second head unit pressure plate 9 and the heat radiating plate 6 permits the thermal head unit 3 to tilt and float forward/rearward and rightward/leftward with respect to the platen roller unit 2.

The head unit pressure lever 5 comprises a head unit pressure shaft 11 having a width substantially equal to the width of the pressure member unit 4, and head unit pressure shaft support members 12 and 13 rotatably supported by the pair of side frame members 1*a*,1*b*.

In order to place the thermal head unit 3 into pressing contact with the platen roller unit 2, the pins 6*b*,6*c* of the heat radiating plate 6 of the thermal head unit 3 are engaged with the grooves 1*c*,1*d* on the pair of side frame members 1*a*,1*b*, respectively. The pressure member unit 4 is then pivoted about the support shaft 7 toward the platen roller unit 2 until the flat surface contact portion 9*a* of the second head unit pressure plate 9 is brought into point contact with the convex spherical contact portion 6*d* of the heat radiating plate 6. The head unit pressure lever 5 is then pivoted manually about the support members 12,13 to a predetermined position until the head unit pressure shaft 11 presses against the first head unit pressure plate 8 to fixedly retain the pressure member unit 4 at the predetermined position on the frame 1, as shown in FIG. 1. At this position, the pressure member unit 4, through the first and second head unit pressure plates 8,9 and the spring 10, biases the thermal head unit 3 into pressing contact with the platen roller unit 2. The head unit pressure lever 5 can be manually released from the pressure member unit retaining position by pivotal movement about the support members 12,13 until the pressure member unit 4 achieves the position shown in FIG. 2.

During a printing operation, a data printing signal is transmitted to the thermal head unit 3 through a flexible printed circuit 14 which is supported by the heat radiating plate 6 through a fixing plate 15.

According to the present invention, the pressure member unit 4, which elastically compresses the thermal head unit 3 into pressing contact with the platen roller unit 2, is retained at the predetermined position by means of the head unit pressure lever 5 so that when the head unit pressure lever 5 is released from its pressure member unit retaining position, the point contact between the flat surface contact portion 9*a* of the second head unit pressure plate 9 and the convex spherical contact portion 6*d* of the heat radiating plate 6 is also released. As a result, the pins 6*b*,6*c* of the heat radiating plate 6 can be removed from the grooves 1*c*,1*d* on the side frame members 1*a*,1*b* and a large opening is provided between the thermal head unit 3 and the platen roller unit 2, thereby making the thermal head unit 3 readily accessible for maintenance or replacement.

Furthermore, since the pressure member unit 4 is in point contact with the thermal head unit 3 and the thermal head unit 3 is in engagement with the pair of side members 1*a*,1*b* of the frame 1 through the pins 6*c*,6*d*, respectively, the thermal head unit 3 is capable of tilting and floating forward/rearward and rightward/leftward relative to the position of the platen roller unit 2. Therefore, when a printing operation is performed, the thermal head unit 3 follows the rotation of the platen roller unit 2 to allow the head unit pressure shaft 11 to contact the first head unit pressure plate 8 of the pressure member unit with uniform pressure.

As described above, according to the present invention, due to the fact that the head unit pressure lever 5 is rotatably provided with respect to the frame 1, the pressure member unit 4, which is rotatably provided on the frame 1, can be retained at a predetermined position by the head unit pressure lever 5, and the pressure contact of the pressure member unit 4 with the thermal head unit 3 head can be easily released by the rotation of the head unit pressure lever 5. As a result, the thermal head unit 3 head can be freely assembled or replaced with a new one with respect to the frame 1 without using any particular tools, thereby simplify the structure of the thermal printer.

Moreover, since the pressure member unit 4 is in point contact with the thermal head unit 3, the printing head can tilt and float forward/rearward and rightward/leftward, and the platen roller unit 2 and the thermal head unit 3 are uniformly held in pressure contact with each other. Therefore, the present invention is also effective in improving the quality of printing and the rectilinearity of the recording medium.

We claim:

1. A thermal printer comprising: a frame having a pair of side frame members opposed to each other at a given distance according to a desired width size standard of a recording medium; a platen roller unit rotatably disposed between the side frame members of the frame; a thermal head unit disposed between the side frame members of the frame and facing the platen roller unit; a pressure member unit rotatably supported by the frame and positionable at a predetermined position for biasing the thermal head unit into pressing contact with the platen roller unit; and a head unit pressure lever rotatably supported by the frame and having a head unit pressure shaft for pressing and retaining the pressure member unit in the predetermined position.

2. A printer according to claim 1; wherein the thermal head unit and the pressure member unit are independent from each other and the thermal head unit can be disassembled from the frame after the pressure applied on the thermal head unit by the pressure member unit is released.

3. A printer according to claim 1; wherein the platen roller unit is detachably supported by the side frame members.

4. A printer according to claim 1; wherein the thermal head unit comprises a heat radiating plate supporting a heat generating element for contacting the platen roller unit.

5. A printer according to claim 4; wherein the pressure member unit comprises first and second head unit pressure plates rotatably supported on the frame to undergo relative movement within a given range, and means for effecting relative movement of the first and second head unit pressure plates within the given range.

6. A printer according to claim 5; wherein the head unit pressure shaft of the head unit pressure lever is rotatably supported between the pair of side frame members for retaining the first head unit pressure plate of the pressure member unit from behind the thermal head unit to bias the heat generating element of the thermal head unit into pressing contact with the platen roller unit.

7. A printer according to claim 5; wherein the thermal head unit has a convex spherical contact portion, and the second head unit pressure plate of the pressure member unit has a flat contact surface portion, the convex spherical contact portion and the flat contact surface portion coming into point contact with each other when the pressure member unit biases the thermal head unit into pressing contact with the platen roller unit.

8. A printer according to claim 7; wherein the thermal head unit and the pressure member unit are independent from each other to enable the thermal head unit to be disassembled from the frame after the pressure applied on the thermal head unit by the pressure member unit is released.

9. A printer according to claim 1; wherein the pressure member unit comprises first and second head unit pressure plates rotatably supported on the frame to undergo relative movement within a given range, and means for effecting relative movement of the first and second head unit pressure plates within the given range.

10. A printer according to claim 9; wherein the thermal head unit has a convex spherical contact portion, and the second head unit pressure plate of the pressure member unit has a flat contact surface portion, the convex spherical contact portion and the flat contact surface portion coming into point contact with each other when the pressure member unit biases the thermal head unit into pressing contact with the platen roller unit.

11. A thermal printer comprising: a frame having a pair of side frame members opposed to each other at a given distance according to a desired width size standard of a recording medium; a platen roller unit rotatably disposed between and detachably supported by the side frame members of the frame; a thermal head unit disposed between the side frame members of the frame and facing the platen roller unit; a pressure member unit rotatably supported by the frame and positionable at a predetermined position for biasing the thermal head unit into pressing contact with the platen roller unit; and a head unit pressure lever rotatably supported by the frame and having a head unit pressure shaft engageable with the pressure member unit for retaining the pressure member unit at the predetermined position and bringing the pressure member unit into point contact with the thermal head unit; wherein during printing, the pressure member unit biases the thermal head unit into pressing contact with the platen roller unit and the thermal head unit can tilt and float forward/rearward and rightward/leftward in relation to the platen roller unit.

12. A printer according to claim 11; wherein the thermal head unit and the pressure member unit are independent from each other to enable the thermal head unit to be disassembled from the frame after the pressure applied on the thermal head unit by the pressure member unit is released.

13. A thermal printer comprising: a frame having a pair of side frame members opposed to each other at a given distance according to a desired width size standard of a recording medium; a platen roller unit rotatably disposed between the side frame members of the frame; a thermal head unit disposed between the side frame members of the frame and facing the platen roller unit, the thermal head unit having a convex spherical contact portion; a pressure member unit positionable at a predetermined position for biasing the thermal head unit into pressing contact with the platen roller unit, the pressure member unit having a first head unit pressure plate and a second head unit pressure plate having a flat contact surface portion, the convex spherical contact portion of the thermal head unit and the flat contact surface portion of the second head unit pressure plate coming into point contact with each other when the pressure member unit biases the thermal head unit into pressing contact with the platen roller unit; and a head unit pressure lever rotatably supported by the frame for retaining the pressure member unit in the predetermined position.

14. A thermal printer according to claim 13; wherein the first and second head unit pressure plates of the pressure member unit are rotatably supported on the frame to undergo relative movement within a given range; and further comprising means for effecting relative movement of the first and second head unit pressure plates within the given range.

15. A thermal printer according to claim 14; wherein the thermal head unit comprises a heat radiating plate supporting a heat generating element for contacting the platen roller unit.

16. A thermal printer according to claim 13; wherein the thermal head unit comprises a heat radiating plate supporting a heat generating element for contacting the platen roller unit.

17. A thermal printer according to claim 16; wherein the heat radiating plate of the thermal head unit has the convex spherical contact portion, and the second head unit pressure plate of the pressure member unit has the flat contact surface portion.

18. A thermal printer according to claim 17, further comprising a biasing member disposed between the first and second head unit pressure plates for biasing the flat surface contact portion of the second head unit pressure plate into point contact with the convex spherical contact portion of the heat radiating plate.

19. A thermal printer according to claim 13; wherein the thermal head unit and the pressure member unit are independent from each other to enable the thermal head unit to be disassembled from the frame after the pressure applied on the thermal head unit by the pressure member unit is released.

* * * * *